US009543707B2

(12) United States Patent
Miyoshi

(10) Patent No.: US 9,543,707 B2
(45) Date of Patent: Jan. 10, 2017

(54) CONNECTOR CASE AND SHELL SECUREMENT

(71) Applicant: Hosiden Corporation, Yao-shi (JP)

(72) Inventor: Toshiharu Miyoshi, Yao (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 14/674,343

(22) Filed: Mar. 31, 2015

(65) Prior Publication Data

US 2015/0295361 A1 Oct. 15, 2015

(30) Foreign Application Priority Data

Apr. 9, 2014 (JP) ..... 2014-080292

(51) Int. Cl.

| | |
|---|---|
| ***H01R 9/03*** | (2006.01) |
| ***H01R 13/6581*** | (2011.01) |
| ***H01R 13/508*** | (2006.01) |
| ***H01R 13/502*** | (2006.01) |

(52) U.S. Cl.

CPC ..... *H01R 13/6581* (2013.01); *H01R 13/502* (2013.01); *H01R 13/508* (2013.01)

(58) Field of Classification Search

CPC ... H01R 13/40; H01R 13/502; H01R 13/5025; H01R 13/504; H01R 13/5045; H01R 13/506; H01R 13/508; H01R 13/512; H01R 13/514; H01R 13/516

USPC ..... 439/607.58, 594, 733.1, 752

See application file for complete search history.

(56) References Cited

U.S. PATENT DOCUMENTS

| | | | | |
|---|---|---|---|---|
| 4,799,901 | A * | 1/1989 | Pirc | H01R 13/6666 333/185 |
| 5,171,161 | A * | 12/1992 | Kachlic | H01R 13/6275 439/352 |
| 5,518,428 | A | 5/1996 | Onoda | |
| 6,824,425 | B2 * | 11/2004 | Fan | H01R 12/7047 439/570 |
| 7,976,352 | B2 * | 7/2011 | Nishimura | H01R 4/36 439/814 |
| 8,066,531 | B2 * | 11/2011 | Kanatsu | H01R 13/6588 439/607.34 |
| 2004/0033725 | A1 | 2/2004 | Schmieding et al. | |
| 2011/0092098 | A1 * | 4/2011 | Yang | H01R 12/724 439/607.37 |
| 2012/0015545 | A1 * | 1/2012 | Wu | H01R 13/5825 439/345 |

FOREIGN PATENT DOCUMENTS

JP 2001155822 A 6/2001

* cited by examiner

*Primary Examiner* — Vanessa Girardi
(74) *Attorney, Agent, or Firm* — The Webb Law Firm

(57) ABSTRACT

A connector includes a shell and a case firmly connected to each other. The connector includes a contact, a contact holder holding the contact, a metal shell accommodating the contact holder and a resin case accommodating the shell. A stopper is provided to be inserted into a first hole portion formed in the case and a second hole portion formed in the shell. The second hole portion has a same shape as the first hole portion and is overlapped with the first hole portion.

5 Claims, 8 Drawing Sheets

CONNECTOR CASE AND SHELL SECUREMENT

CROSS REFERENCE TO RELATED APPLICATION

Figure 1:
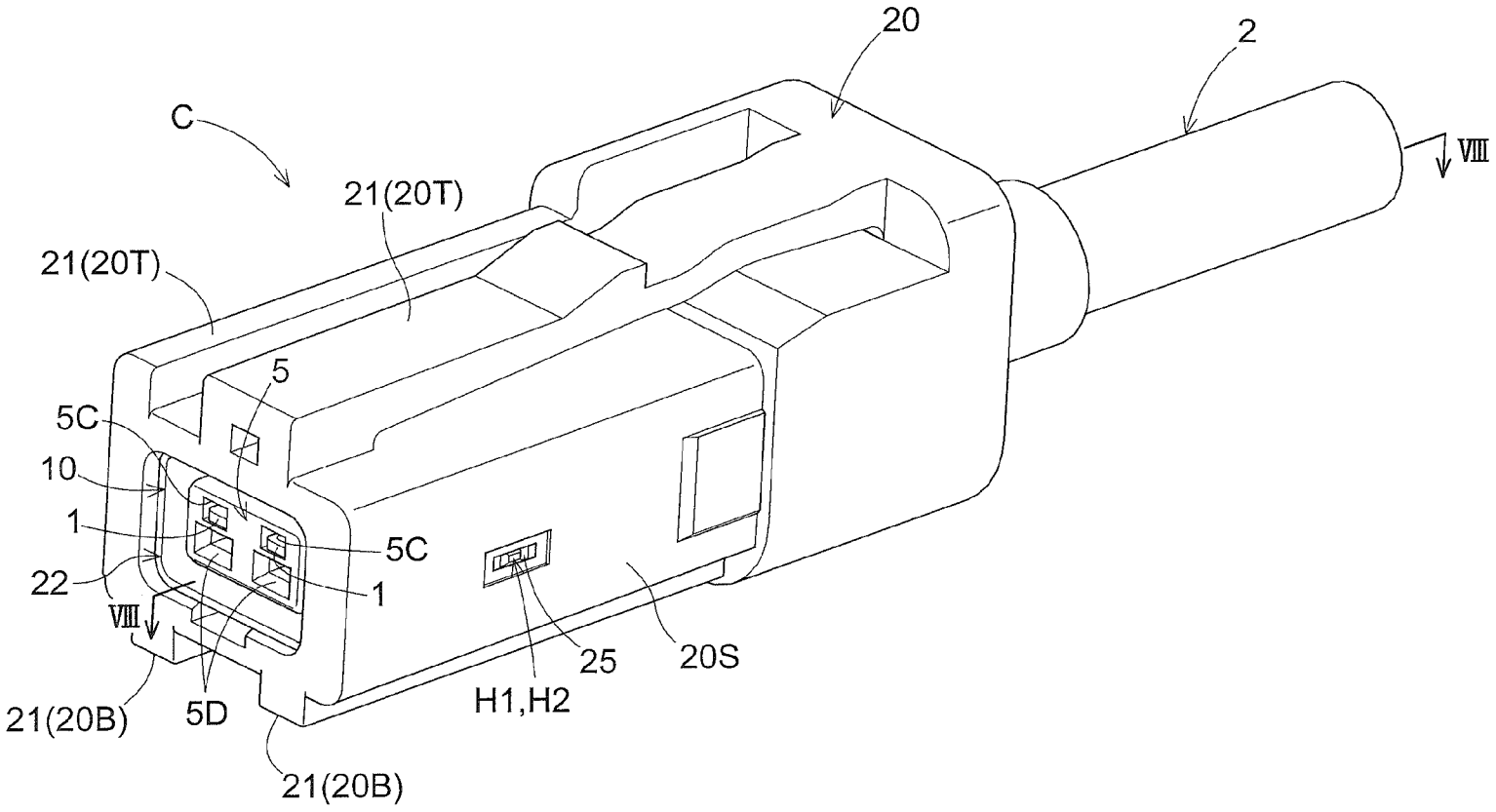

This application is based on and claims priority under 35 U.S.C. Section 119 to Japanese Patent Application No. 2014-080292 filed on Apr. 9, 2014, the entire contents of which are incorporated herein by reference.

TECHNICAL FIELD

This disclosure relates to a connector, more particularly to a connector including a shell housed in a case.

RELATED ART

Generally, in the above-described connector, for the purpose of improvement of its EMI (electro-magnetic interference) characteristics, a contact holder including contacts is covered by a cylindrical shell. This connector is assembled by a process wherein the contact holder, etc. are disposed inside the shell in advance and then this shell is inserted into e.g. a hole portion of a case.

Japanese Unexamined Patent Application Publication No. 2001-155822 discloses a connector configured such that a retaining (engaging) protrusion of a lance formed integral in a case formed of resin (shown as "a housing" in the document) is engaged in an engaging hole of a shell (shown as "a shield terminal" in the document) for regulating relative movement between the case and the shell. With this connector, when the shell is inserted into the case, the retaining protrusion of the lance, by an elastic protruding force thereof, reaches a state of engagement into the engaging hole, thus completing the assembly.

SUMMARY

With the connector assembled as shown in the JP2001-155822 above, even if a relative moving force is applied between the case and the shell toward the direction of the insertion of the shell to the case, contact between the engaging protrusion and the engaging hole prevents separation between the case and the shell.

However, even with the connector configured as shown in the JP2001-155822 above, if the protruding force of the engaging protrusion of the lance decreases due to aging or result of repeated operations of insertion and withdrawal by an operator holding the case, the engaging protrusion of the lance can be easily disengaged from the engaging hole, thus leading to inadvertent detachment of the case from the shell. In this regard, there remains room for improvement.

An embodiment of this disclosure discloses a connector capable of connecting a shell and a case to each other firmly.

A connector according to an embodiment of this disclosure comprises:

a contact coming into contact with a connection target to be electrically connected thereto;

a contact holder formed of resin, the contact holder housing and holding the contact therein;

a shell formed of metal and accommodating the contact holder;

a case formed of resin and accommodating the shell; and a stopper inserted into a first hole portion formed in the case and a second hole portion formed in the shell, the second hole portion having a same shape as the first hole portion and being overlapped with the first hole portion.

With the above embodiment configuration, when the stopper is inserted into the first hole portion of the case and the second hole portion of the shell with the shell being accommodated in the case, this stopper prevents relative movement between the shell and the case in the event of application of a force causing such relative movement between the shell and the case. Namely, in comparison with the conventional configuration wherein a retaining protrusion of a lance formed integral with the case is engaged in an engaging hole of the shell, the insertion of a stopper into hole portions of the case and the shell can provide stronger connection therebetween. This arrangement is also reasonable in that replacement of the stopper alone will suffice to cope with looseness which may be developed in the connection between the case and the shell.

Further, the embodiment configuration described above is advantageous also in that the insertion of the stopper from the outer side of the case allows visual confirmation of presence/absence of the stopper from the outer side of the case. In this way, there has been realized a rational connector that allows firm connection between the shell and the case.

According to a further embodiment of this disclosure, the first hole portion and the second hole portion have rectangular opening shapes;

an inner end of the stopper which comes into contact with an outer wall of the contact holder has a same shape as the opening shapes of the first and second hole portions; and when the stopper is inserted into the first hole portion and the second hole portion, the inner end of the stopper comes into contact with the outer wall of the contact holder.

With the above-described configuration, as the inner end of the stopper has a rectangular shape, this stopper can be readily manufactured by e.g. a presswork of a plate member. Further, this inner end of the stopper is inserted to a position to come into contact with the outer wall of the contact holder. Namely, as the stopper is disposed as being inserted through the second hole portion, retention of the stopper relative to the shell can be rendered reliable. Moreover, by a frictional force generated at the time of face contact between the rectangular-shaped inner end of the stopper and the outer wall of the contact holder allows reliable position regulation of the contact holder as well.

According to a further embodiment of this disclosure, when the case is inserted into an engaging hole portion of a socket accommodating the connection target, the stopper is located at a position covered by an inner wall of the engaging hole portion.

With the above-described configuration, under a state of the connector being inserted into the engaging hole portion of the socket, if e.g. the stopper should be withdrawn toward the outside of the stopper due to vibration, since an outer end of the stopper is in contact with the inner face of the engaging hole portion of the socket, detachment of the stopper can be prevented.

According to a still further embodiment of the connector relating to this disclosure:

the stopper is formed of a metal material;

the outer wall of the contact holder forms a groove portion along an insertion/withdrawal direction of the socket for coming into contact with the inner end of the stopper; and a wall-like end face capable of coming into contact with a lateral edge of the stopper is formed at a position in the groove portion opposite and away from the socket.

With the above-described configuration, since the inner end of the stopper comes into contact with the groove portion formed in the outer wall of the contact holder, positioning of the stopper is made reliable. Further, the arrangement is provided for allowing the stopper formed of metal to come into contact with the wall-like end face of the groove portion. Therefore, even if displacement occurs in the relative position among the contact holder, the case and the shell after repetition of inserting/withdrawing operations by a user holding the case, as the metal stopper having high durability contacts the wall-like end face, detachment of the contact holder to the socket side can be prevented reliably.

BRIEF DECRIPTION OF DRAWINGS.

Figure 2:
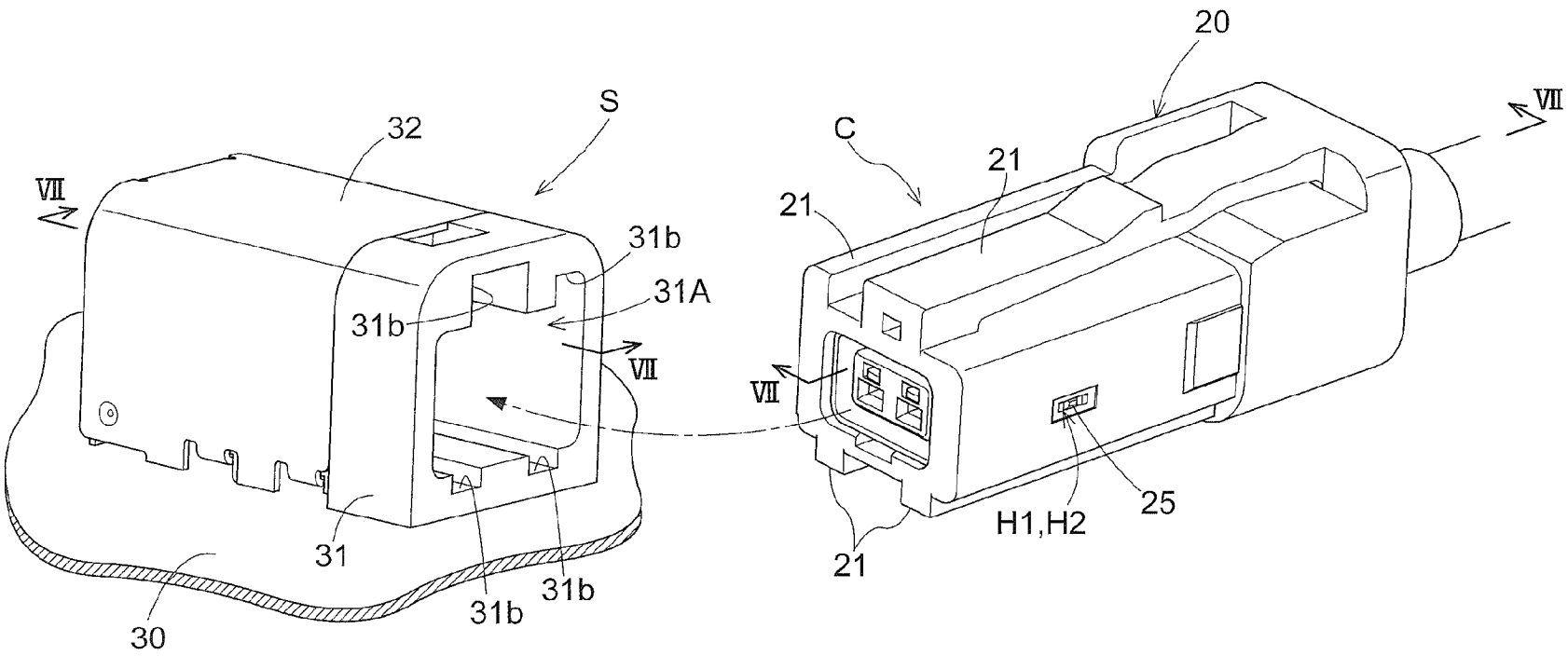
Figure 3:
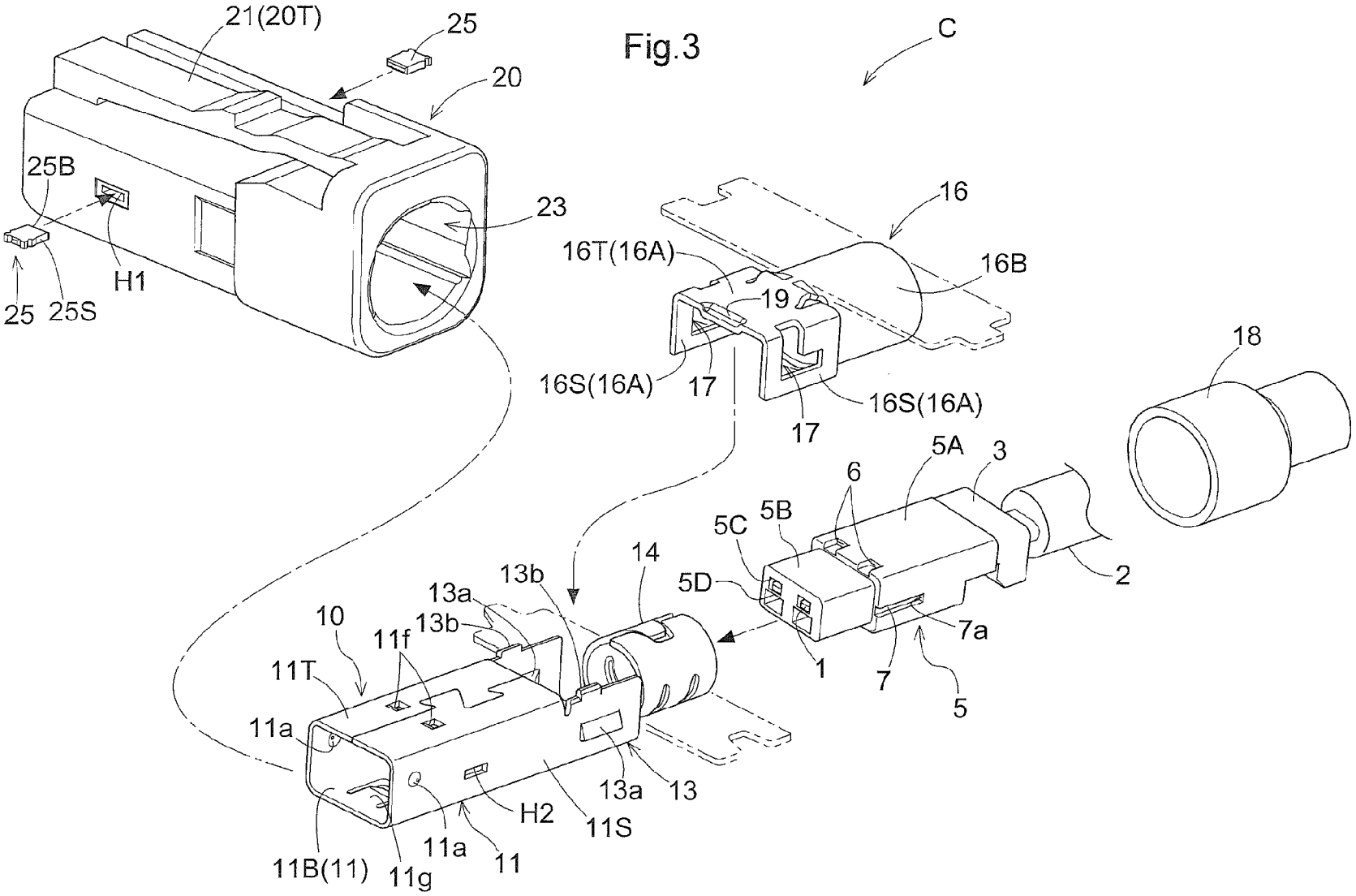
Figure 4:
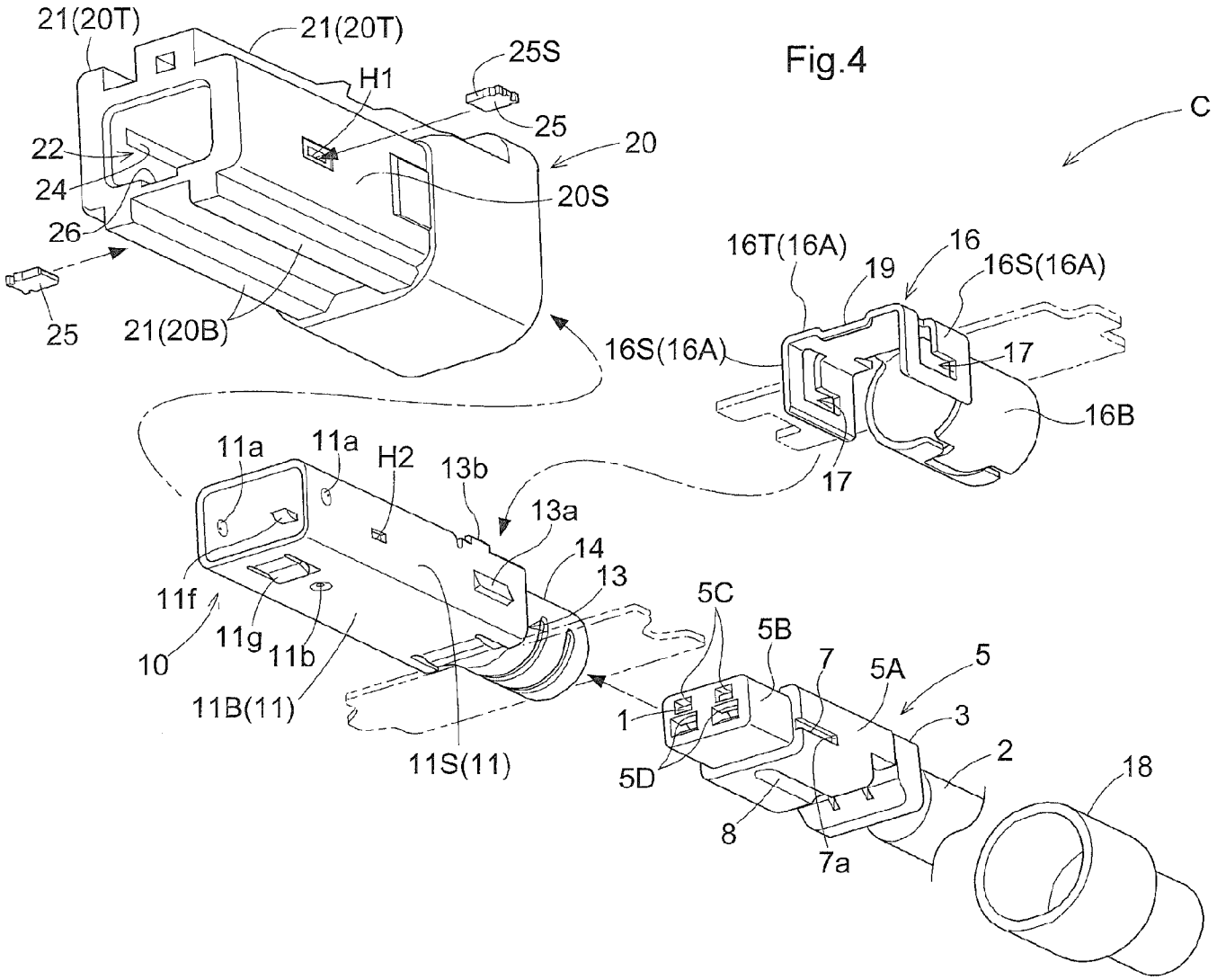
Figure 5:
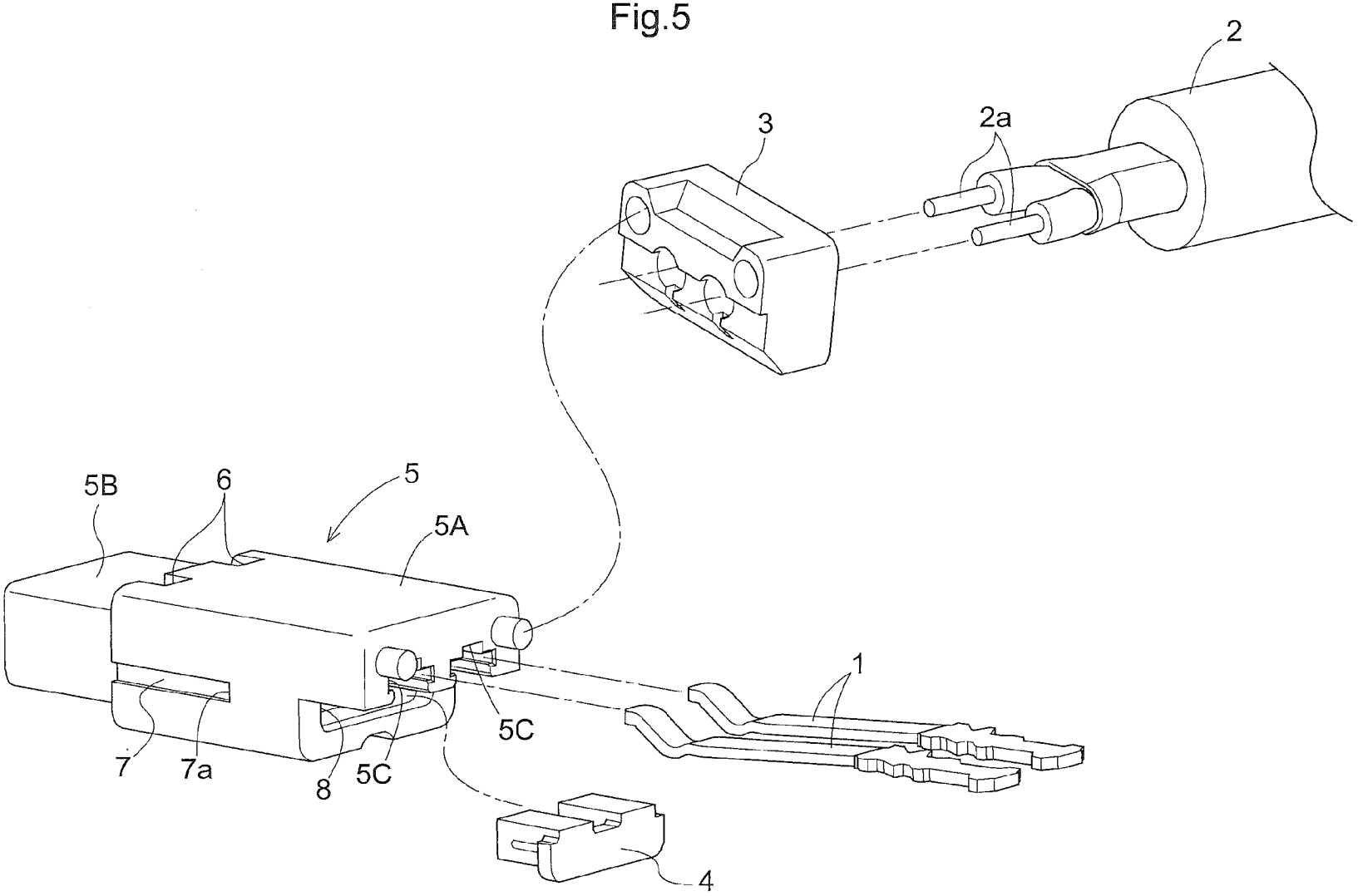
Figure 6:
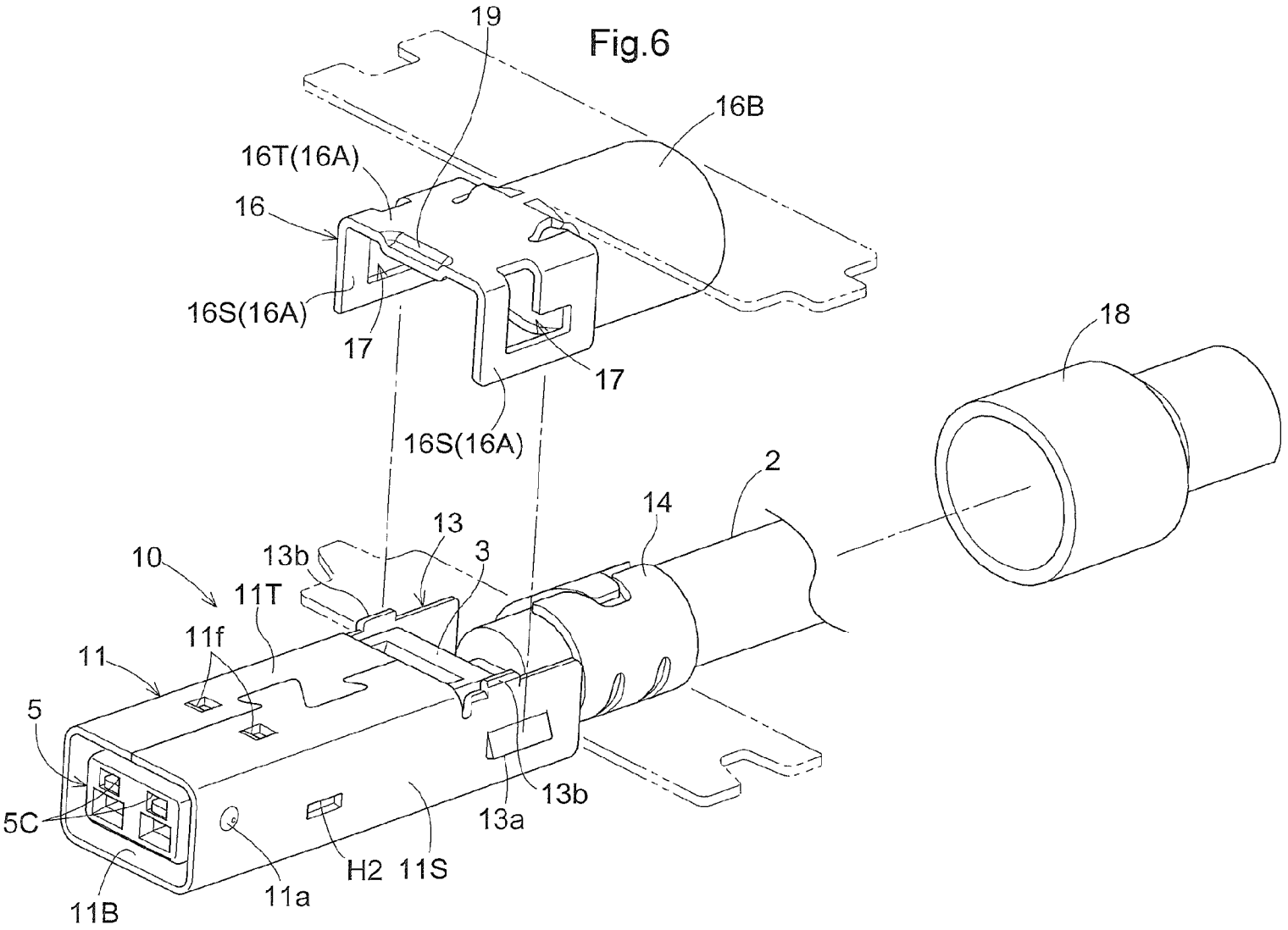
Figure 7:
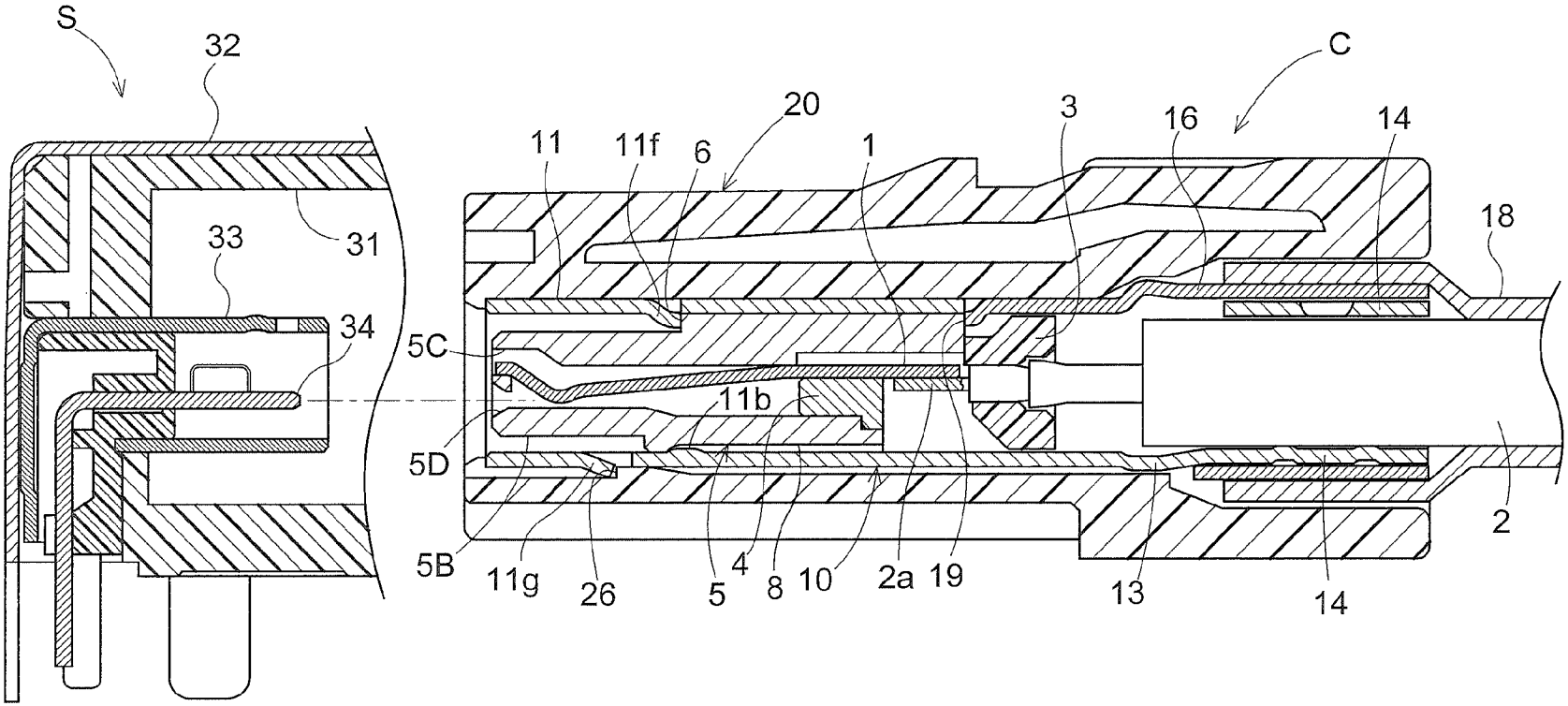
Figure 8:
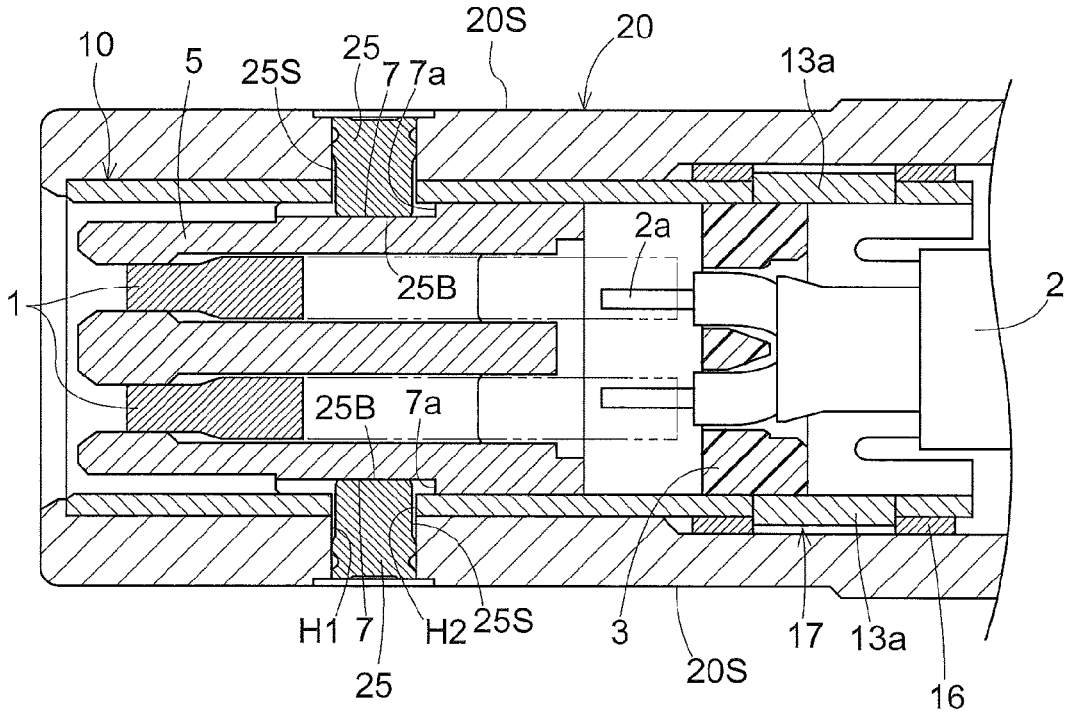
Figure 9:
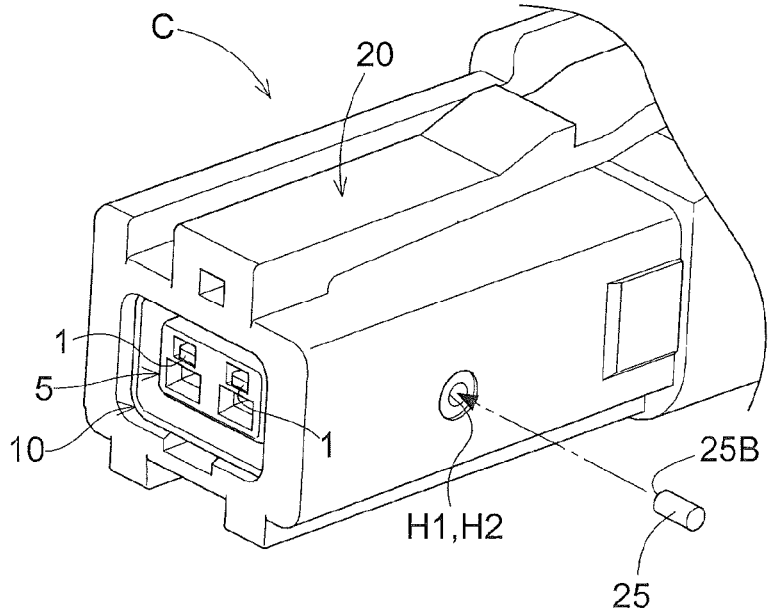

FIG. 1 is an upper perspective view of a connector,

FIG. 2 is a perspective view illustrating the connector being inserted into a socket, FIG. 3 is an exploded perspective view showing the connector as seen from the upper side thereof, FIG. 4 is an exploded perspective view showing the connector as seen from the lower side thereof, FIG. 5 is a perspective view illustrating assembly of contacts, etc. to a contact holder, FIG. 6 is a perspective view illustrating engaging of a shell cover and a sleeve to a shell, FIG. 7 is a side view showing the connector and the socket as seen in section along a direction VII-VII in FIG. 2, FIG. 8 is a section view showing the connector as seen in section along a direction VIII-VIII in FIG. 1, and FIG. 9 is an upper perspective view showing a connector according to a further embodiment.

DESCRIPTION OF EMBODIMENTS

Next, embodiments of the disclosure will be explained with reference to the accompanying drawings. It should be noted, however, that the disclosure is not limited to these embodiments, but can be modified in various ways as long as not departing from the essence thereof.

FIG. 1 is a perspective view showing a connector C according to this embodiment. FIG. 2 is a perspective view illustrating the connector C being inserted into a socket S. FIGS. 3 and 4 are exploded perspective views showing the connector C as seen from the upper side and the lower side thereof, respectively. FIG. 5 is an exploded perspective view showing contacts 1, a cable 2, a spacer 3, a position regulating member 4, and a contact holder 5. FIG. 6 is an exploded perspective view showing a shell 10, a shell cover 16 and a sleeve 18. FIG. 7 is a section view taken along a line VII-VII in FIG. 2. FIG. 8 is a section view showing the connector C as seen in the direction VIII-VIII in FIG. 1. Incidentally, although the connector C can be used regardless of its vertical relationship (orientation), the following explanation is based on an assumption of vertical relationship of an upper wall 20T of a case 20 being oriented upwards, and the side on which the connector C is inserted into the socket S shown in FIG. 2 will be referred to the front side and the side opposite thereto will be referred to as the rear side, respectively.

The connector C, as shown in FIG. 1 and FIG. 7, includes a pair of contacts 1 formed of metal which come into contact with conductor bodies 34 (an example of "connection target") mounted in the socket S to be electrically connected to the conductor bodies 34, a resin contact holder 5 housing and holding the contacts 1 therein, a metal shell 10 accommodating the contact holder 5 and a resin case 20 accommodating the shell 10. Incidentally, the conductor bodies 34 will be described in details later.

This connector C, as shown in FIG. 2, functions as a plug to be connected to the socket S.

[Contact Holder]

As shown in FIGS. 3-4, the pair of contacts 1 comprise good conductor having superior spring property such as copper alloy, and these contacts 1 are disposed inside guide hole portions 5C formed in the contact holder 5 formed of insulating resin. As shown in FIG. 5, to each contact 1, a lead 2*a* of a cable 2 is conductively connected by such technique as welding. And, a pair of leads 2*a* of the cable 2 are fixed in position via a spacer 3 formed of insulating resin. Further, the pair of contacts 1 are fixed in position relative to the contact holder 5 by the position regulating member 4 formed of insulating resin.

The contact holder 5 comprises a block-like body integrally forming a holder body 5A and a guide portion 5B provided at the front end of the holder body 5A and having smaller width and thickness than the holder body 5A. To this guide portion 5B, a guide tube portion 33 of the socket S will be engaged along its outer circumference, when the connector C is inserted into the socket S, as illustrated in FIG. 7.

Further, the contact holder 5 forms a pair of guide hole portions 5C in which the contacts 1 are disposed, the guide hole portions 5C extending from the holder body 5A to the guide portion 5B. As shown in FIG. 7, inside a rear portion communicated to the guide hole portions 5C, the above-described position regulating member 4 is mounted. Downwardly of the front end of the guide portion 5B, there are defined a pair of inserting hole portions 5D. As the conductors bodies 34 of the socket S are inserted into the inserting hole portions 5D, electric connection is established inside the connector C between the contacts 1 and the conductor bodies 34.

As shown in FIG. 3, in the upper face of the holder body 5A, there are formed a pair of engaging recesses 6 having bottom faces to be in flush with the outer face of the guide portion 5B. In opposed lateral faces of the holder body 5A, there are formed groove portions 7 along the insertion/withdrawal direction of the socket S (the direction along which the connector S is inserted or withdrawal relative to the socket 5). Each groove portion 7 has a wall-like end face 7*a* on its rear side (side opposite the socket 5) and has a shape whose front side (the side of the socket 5) is opened. Further, as shown in FIG. 4, in the bottom face of the holder body 5A, a bottom face groove 8 is formed.

[Shell]

As shown in FIG. 6, the shell 10 is formed by a presswork of a metal plate into a structure including integrally a shell body 11 having an angular tubular shape, an intermediate wall portion 13 continuous from lateral wall portions 11S of the shell body 11 and having an upwardly opened U-shape, and a cable holding portion 14 continuous from the bottom wall of the intermediate wall portion 13 for crimping and holding the cable 2. From the opened side of the intermediate wall portion 13, a shell cover 16 made of metal is attached. Incidentally, the cable holding portion 14 is under an opened state indicated by dotted lines, prior to attachment of the cable 2.

The shell cover 16 comprises an integrally formed structure consisting of a connecting portion 16A and a cable cover portion 16B formed cylindrical. Further, in the connecting portion 16A, there are formed an upper wall member 16T and a pair of lateral wall members 16S. Each lateral wall member 16S defines a connecting hole portion 17. Further, in the upper wall member 16T, there is formed a front recess 19 having its front side cutaway. Incidentally, prior to attachment of the cable cover portion 16B to the cable 2, the shell cover 16 is under the opened state indicated by the dotted lines.

The intermediate wall portion 13 is formed at positions continuous from the lateral wall portions 11S of the shell body 11 and in this intermediate wall portion 13, engaging pieces 13*a* engageable with the connecting hole portions 17 of the shell cover 16 are formed by bending the intermediate wall portion 13 to the outer side. And, at the upper end portion of this intermediate wall portion 13, protruding pieces 13*b* engageable into the connecting hole portions 17 of the shell cover 16 are formed to protrude upwards.

In an upper wall portion 11T of the shell body 11, a pair of upper engaging pieces llf engageable into the pair of engaging recesses 6 of the contact holder 5 are formed by bending portions of the upper wall portion 11T inwards.

In the lateral wall portions 11S of the shell body 11 on the both sides thereof, lateral wall projections lla projecting outwards are formed. And, in these lateral wall portions 11S, there are also formed second hole portions H2.

As shown in FIG. 4, in a bottom wall portion 11B of the shell body 11, there is formed a lower engaging piece llg by bending a portion of the bottom wall portion 11B outwards, and in this bottom wall portion 11B, there is also formed a bottom wall projection llb projecting inwards.

[Case]

As shown in FIGS. 3 and 4, the case 20 comprises an angular tubular structure having an upper wall 20T, a lower wall 20B and a pair of lateral walls 20S. Further, in the outer face of this case 20, a plurality of protruding guides 21 serving for prevention of erroneous insertion relative to the socket S are formed along the insertion/withdrawal direction (the direction along which the connector S is inserted/withdrawn relative to the socket 5).

On the front end side of this case 20, there is formed an angular front hole portion 22 for accommodating the shell 10 in gapless fitting manner, and at a position continuous therefrom, there is formed a rear hole portion 23 having a larger vertical inner size and larger right/left inner size than the front hole portion 22.

In the lower wall 20B, there is formed a cutout portion 26 having its bottom face cutout to be engageable with the lower engaging piece llg of the shell 10. When the shell 10 etc. is inserted from the rear hole portion 23, the lower engaging piece llg will be elastically deformed and then elastically resiled at the position of the cutout portion 26, thereby regulating relative movement of the shell 10 toward the rear side relative to the case 20.

In the inner faces of the pair of lateral walls 20S, there are formed lateral wall guide grooves 24 as grooves engageable with the lateral wall projections lla of the shell 10. When the shell 10 etc. is inserted from the rear hole portion 23, the lateral wall projections lla will be guided by the lateral wall guide grooves 24 and eventually come into contact with the front end portions of the lateral wall guide grooves 24, thus regulating relative movement of the shell 10 toward the front side relative to the case 20.

Further, in the pair of lateral walls 20S, there are formed first hole portions H1. As shown in FIG. 8, each of these first hole portions H1 is formed at a position to be overlapped with the corresponding second hole portion H2 of the shell 10 when the shell 10 is inserted therein. Further, the cross sectional shape of the first hole portion H1 (the opening shape of the hole portion) is a rectangular shape; and the cross sectional shape of the second hole portion H2 (the opening shape of the hole portion) is also a rectangular shape which is same as and of equal size to the first hole portion H1.

[Stopper]

As shown in FIG. 8, with this connector C, the shell body 11 of the shell 10 will be inserted from the rear hole portion 23 of the case 20 and under this condition, a stopper 25 will be inserted through the first hole portion H1 of the case 20 and the second hole portion H2 of the shell 10, thus realizing prevention of inadvertent withdrawal of the shell 10 relative to the case 20. And, this stopper 25 is formed of metal material and has a rectangular cross section to be fitted and engaged in a gapless manner within the first hole portion H1 and the second hole portion H2 and a linear lateral edge 25S is formed along the direction of insertion.

The stopper 25 will be inserted through the first hole portion H1 and the second hole portion H2 and disposed such that its rectangular inner end 25B may fit into the groove portion 7 of the contact holder 5 to come into contact with the bottom wall of this groove portion 7. In this way, the stopper 25 is formed like a plate and the shape of inner end 25B which comes into contact with the outer wall of the contact holder 5 has the rectangular shape which is same as the opening shapes of the first hole portion H1 and the second hole portion H2. Thus, this stopper 25 can be readily manufactured by a presswork. Incidentally, in order to ensure reliable withdrawal prevention of this stopper 25, the opening shape of the first hole portion H1 can be made slightly smaller than the cross sectional shape of the stopper 25.

In particular, when this connector C is inserted into the engaging hole portion 31A of the socket S, the stoppers 25 are set at positions covered by the inner walls of the engaging hole portions 31A, whereby inadvertent detachment of the stoppers 25 is prevented.

[Assembly of Connector]

For assembling this connector C, firstly, as illustrated in FIG. 5, the contact 1 is inserted into the guide hole portion 5C from the rear side of the contact holder 5 and the position regulating member 4 is attached. Then, the leading end portions of the cable 2 are inserted into the lower holes of the spacer 3 and the spacer 3 is fixed to the rear end of the contact holder 5. Under this condition, the contacts 1 and the leads 2*a* of the contacts 1 are welded to each other to establish conductive connection therebetween.

Next, as shown in FIGS. 3-4, the contact holder 5 including the pair of contacts 1 etc. is inserted to the inside of the shell 10 from the rear side of the shell 10 whose cable holding portion 14 is under the opened state. In the course of this insertion, the bottom face of the contact holder 5 rides over and past the bottom wall projection llb of the shell 10, and the bottom wall projection llb comes into engagement within the bottom face groove 8 of the contact holder 5, and the pair of upper engaging pieces llf of the shell 10 come into contact with the pair of engaging recesses 6 of the contact holder 5. In this way, when the contact holder 5 and the shell 10 are assembled integrally, between the inner circumferential face of the shell body 11 and the outer circumferential face of the guide portion 5B of the contact holder 5, there is formed a guide gap having a constant spacing (see FIG. 7).

Next, as illustrated in FIG. 6, with the cable cover portion 16B of the shell cover 16 being kept opened, the connecting hole portions 17 of he shell cover 16 are engaged with the engaging pieces 13*a* of the intermediate wall portion 13 of the shell 10, and also the protruding pieces 13*b* of the intermediate wall portion 13 of the shell 10 are engaged into the connecting hole portions 17, thereby to integrate the shell cover 16 and the shell 10 to each other. In the course of this, as illustrated in FIG. 7, the front recess 19 of the shell cover 16 comes into contact with the rear end of the contact holder 5, thereby to regulate rearward movement of the contact holder 5; and the upper engaging pieces llf of the shell 10 come into contact with the engaging recesses 6 of the contact holder 5, thereby to regulate forward movement of the contact holder 5. With this, the contact holder 5 is fixed in position inside the shell 10.

Under the above-described condition, the cable 2 is enclosed and crimped within the cable holding portion 14 of the shell 10 and the cable cover portion 16B is wound around the outer face of the cable holding portion 14 and crimped thereto and a sleeve 18 formed of resin is gaplessly fitted on a position covering the above components.

Thereafter, as shown in FIGS. 3-4, the shell 10 including the contact holder 5, the shell cover 16, etc. is inserted into the case 20 from its rear side, whereby the outer face of the shell body 11 of the shell 10 is placed in gapless contact with the front hole portion 22 of the case 20, and the shell cover 16, etc. is disposed inside the rear hole portion 23. In the course of this, the lateral wall projections lla of the shell 10 are guided by the lateral wall guide grooves 24 of the case 20 and also the lower engaging piece llg of the shell 10 comes into engagement with the cutout portion 26 of the case 20, whereby relative movement of the shell 10 relative to the case 20 is regulated.

Under the above condition, the first hole portion H1 formed in each lateral wall 20S of the case 20 and the second hole portion H2 formed in each lateral wall portion 11S of the shell body 11 are disposed at positions overlapped with each other. Next, into these first hole port ion H1 and second hole portion H2, the stopper 25 is inserted. Thus, even if an external force is applied to cause relative movement between the shell 10 and the case 20, such relative movement is prevented by the stopper 25, thus firmly integrated state of the shell 10 and the case 20 is realized.

In particular, as illustrated in FIG. 8, since the inner end 25B of the stopper 25 is inserted to the position in contact with the bottom wall of the groove portion 7 of the contact holder 5, even if the inner end 25B of the stopper 25 should be slightly displaced outwards, as the inner end 25B side of the stopper 25 maintains the engagement with the second hole portion H2, inadvertent detachment can be avoided reliably. Further, even when looseness is developed in the engagement between the contact holder 5 and the shell 10 after repeated insertion/withdrawal of the connector C, as the stopper 25 is in abutment against the wall-like end face 7*a* of the groove portion 7, forward detachment of the contact holder 5 is prevented.

[Socket]

Next, the socket S will be explained. As shown in FIG. 2 and FIG. 7, in this socket S, a portion of an outer face of a housing 31 formed of resin and forming the engaging hole portions 31A is covered by a metal shield 32 and inside the engaging hole portions 31A, there are provided a metal guide tubular portion 33 and a pair of the conductor bodies 34 formed of good conductor such as copper alloy or the like.

FIG. 2 shows an embodiment of the socket S being mounted on a circuit board 30, and the pair of conductor bodies 34 (see FIG. 7) are conductively connected to e.g. a printed wiring of the circuit board 30. In the inner circumference of each engaging hole portion 31A, there is formed a recessed groove 31*b* into which the protruding guide 21 provided in the outer face of the case 20 of the connector C can engage. Further, under the condition of the connector B being connected to the socket S (the condition of the conductor bodies 34 being inserted into the inserting hole portions 5D of the contact holder 5), the guide tubular portion 33 will reach to fit into the guide gap formed between the shell 10 and the contact holder 5 of the connector C.

In case the connector C is fitted into and connected with the socket S in the manner described above, the relative position between the guide tubular portion 33 and the shell 10 is fixedly determined, so that the pair of contacts 1 come into contact with the conductor bodies 34 to form electric conduction therewith.

In particular, the arrangement of the stopper 25 in the connector C is set such that the stopper 25 may be placed at a position covered by the inner wall of the engaging hole portion 31A of the socket S when the case 20 of the connector C is inserted into the engaging hole portion 31A of the socket S.

[Effects of Embodiment]

As described above, in the instant embodiment, the stopper 25 is inserted into the first hole portion H1 of the case 20 and the second hole portion H2 of the shell 10. With this, even when operations of inserting/withdrawing by an operator holding the case 20 are effected in repetition and there is applied a force in the insertion/withdrawal direction between the shell 10 and the case 20, the stopper 25 prevents relative movement between the shell 10 and the case 20, thus connecting these firmly to each other.

Further, since a metal member having a rectangular inner end shape is employed as the stopper 25, this stopper 25 can be manufactured by a simple process of a presswork on a metal plate or the like. Moreover, since the stopper 25 formed of metal is used in the mode of being inserted from the outer face side of the case 20, not only firm and highly durable connection, but also visual confirmation of detachment/attachment of the stopper 25 from the outer face side of the case 20 are made possible. Even if looseness should be developed in the connection between the shell 10 and the case 20, this can be coped with by simple replacement of the stopper 25 alone, thus being rational.

Moreover, at the time of insertion/withdrawal of the connector C, the inner faces of the first hole portion H1 and the second hole portion H2 come into contact with the lateral edge 25S of the stopper 25, thus exerting a force in a shearing direction. However, as this force is effective in the direction perpendicular to the lateral edge 25S, this force can be received in a reliable manner. Even if displacement should occur in the relative position among the contact holder 5, the shell 10 and the case 20, as a result of repeated operator's insertion/withdrawal operations with holding the case 20, the stopper 25 having high durability comes into contact with the wall-like end face 7*a* of the contact holder 5, thus preventing detachment of the contact holder 5 toward the socket S side.

Moreover, since the inner end 25B of the stopper 25 is inserted up to the position contacting the outer face of the contact holder 5, even if the stopper 25 should be slightly displaced outwards, the engagement of the inner end 25B side of the stopper 25 with the second hole portion H2 can be maintained.

In particular, when the connector C is connected to the socket S, the stopper 25 is disposed at the position covered by the inner wall of the engaging hole portion 31A of the housing 31 of the socket S, so that even if a force is applied to the stopper 25 in its withdrawal direction due to vibration being applied intermittently under this connected condition, the contact with the inner face of the engaging hole portion 31A effectively prevents detachment.

[Other Embodiments]

(1) In the foregoing embodiment, as the stopper 25, there was employed one having a rectangular-shaped inner end 25B. Instead, as shown in FIG. 9, it is also possible to employ a cylindrical pin having a circular inner end 25B as the stopper 25. Further, it is also possible to provide stoppers 25 at two or more positions. Incidentally, the shape of the stopper 25 is not particularly limited, and its inner end shape can be polygonal shape also.

(2) In the foregoing embodiment, in the groove portion 7 of the contact holder 5 to which the inner end 25B of the stopper 25 comes into contact, at the position opposite the socket S, the wall-like end face 7*a* was provided. Further, a wall-like end face can be provided also on the socket S side. Also, the size of the groove portion 7 can be set equal to the inner end shape of the stopper 25. In this case, it becomes possible to connect the shell 10 and the case 20 and the contact holder 5 to each other in a firm manner. Incidentally, an arrangement can be provided such that the inner end 25B of the stopper 25 comes into contact with the outer wall of the contact holder 5, with omission of the groove portion 7.

(3) In addition to the above, the modes of engagements and fitting between the respective members can vary in any desired manner and are not particularly limited.

The invention claimed is:

1. A connector comprising:

a contact coming into contact with a connection target to be electrically connected thereto;

a contact holder formed of resin, the contact holder housing and holding the contact therein;

a shell formed of metal and accommodating the contact holder;

a case formed of resin and accommodating the shell; and a stopper inserted into a first hole portion formed in the case and a second hole portion formed in the shell, the second hole portion having a same shape as the first hole portion and being overlapped with the first hole portion, wherein the first hole portion and the second hole portion have rectangular opening shapes;

an inner end of the stopper which comes into contact with an outer wall of the contact holder has a same shape as the opening shapes of the first and second hole portions; and when the stopper is inserted into the first hole portion and the second hole portion, the inner end of the stopper comes into contact with the outer wall of the contact holder.

2. The connector according to claim 1, wherein when the case is inserted into an engaging hole portion of a socket accommodating the connection target, the stopper is located at a position covered by an inner wall of the engaging hole portion.

3. The connector according to claim 2, wherein:

the stopper is formed of a metal material;

the outer wall of the contact holder forms a groove portion along an insertion and withdrawal direction of the socket for coming into contact with the inner end of the stopper; and a wall-like end face capable of coming into contact with a lateral edge of the stopper is formed at a position in the groove portion opposite and away from the socket.

4. A connector comprising:

a contact coming into contact with a connection target to be electrically connected thereto;

a contact holder formed of resin, the contact holder housing and holding the contact therein;

a shell formed of metal and accommodating the contact holder;

a case formed of resin and accommodating the shell; and a stopper inserted into a first hole portion formed in the case and a second hole portion formed in the shell, the second hole portion having a same shape as the first hole portion and being overlapped with the first hole portion, wherein when the case is inserted into an engaging hole portion of a socket accommodating the connection target, the stopper is located at a position covered by an inner wall of the engaging hole portion.

5. The connector according to claim 4, wherein:

the stopper is formed of a metal material;

the outer wall of the contact holder forms a groove portion along an insertion and withdrawal direction of the socket for coming into contact with the inner end of the stopper; and a wall-like end face capable of coming into contact with a lateral edge of the stopper is formed at a position in the groove portion opposite and away from the socket.

* * * * *